US008654027B2

(12) United States Patent
Petersson et al.

(10) Patent No.: US 8,654,027 B2
(45) Date of Patent: Feb. 18, 2014

(54) ANTENNA ARRANGEMENT

(75) Inventors: Sven Oscar Petersson, Savedalen (SE); David Astely, Bromma (SE); Bjorn Gunnar Johannisson, Kungsbacka (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 145 days.

(21) Appl. No.: 13/320,802

(22) PCT Filed: May 27, 2009

(86) PCT No.: PCT/EP2009/056444

§ 371 (c)(1),
(2), (4) Date: Nov. 16, 2011

(87) PCT Pub. No.: WO2010/136063

PCT Pub. Date: Dec. 2, 2010

(65) Prior Publication Data

US 2012/0068907 A1 Mar. 22, 2012

(51) Int. Cl.
*H01Q 21/00* (2006.01)

(52) U.S. Cl.
USPC ..... 343/853; 343/798; 343/797; 342/373

(58) Field of Classification Search
USPC ..... 343/797, 798, 853, 893; 342/373
See application file for complete search history.

(56) References Cited

U.S. PATENT DOCUMENTS

| | | | | |
|---|---|---|---|---|
| 4,649,391 | A * | 3/1987 | Tsuda et al. | 342/153 |
| 5,943,011 | A * | 8/1999 | Acoraci et al. | 342/373 |
| 8,063,822 | B2 * | 11/2011 | Adams et al. | 342/373 |
| 2006/0068848 | A1 | 3/2006 | Shapira et al. | |

FOREIGN PATENT DOCUMENTS

| | | | |
|---|---|---|---|
| CN | 1868089 | A | 11/2006 |
| CN | 101091285 | A | 12/2007 |
| EP | 1633016 | A2 | 3/2006 |

OTHER PUBLICATIONS

Official Action issued in corresponding Chinese Application No. 200980159526.1 on Jul. 17, 2013, 2 pages.

* cited by examiner

*Primary Examiner* — Dieu H Duong
(74) *Attorney, Agent, or Firm* — Rothwell, Figg, Ernst & Manbeck, P.C.

(57) ABSTRACT

An antenna arrangement (200, 300, 400) with antenna units (220, 230) comprising an input port (201, 202), a power divider (202, 204) for dividing an input signal into a major and a minor part with a ratio 11, a network (211, 216) with a sum input port, a difference input port, and first and second output ports, first (215, 217) and second antenna (214, 218) elements of a first and a second polarization. Signals to the sum input port are output with a first relation between them and signals to the difference input port are output with a second phase relation. The antenna units are arranged so that the major part of an input signal is connected to the sum port of a network and the minor part of an input signal is connected to the difference port of another network, and the first and second output ports of a network are connected to first and second adjacent antenna elements of the same polarization.

10 Claims, 5 Drawing Sheets

ANTENNA ARRANGEMENT

CROSS-REFERENCE TO RELATED APPLICATION

This application is a 35 U.S.C. §371 National Phase Entry Application from PCT/EP2009/056444, filed May 27, 2009, and designating the United States.

TECHNICAL FIELD

The present invention discloses an improved antenna arrangement.

BACKGROUND

So called array antennas, i.e. antennas with a plurality of antenna elements arranged in an array, are common in, for example, systems for cellular telephony. A common embodiment of an array antenna is a so called column antenna with dual polarized antenna elements, in which antenna elements with differing polarizations are arranged in pairs, with each pair comprising one antenna element of each polarization, usually arranged as a cross.

A common problem with array antennas, particularly column antennas, in cellular telephony systems is that the azimuth beam width obtained by means of the individual antenna elements is sufficiently big to cause a variety of problems, among them interference.

SUMMARY

As explained above, there is a need for a solution by means of which an antenna arrangement, such as an antenna column with N columns, can be given reduced half power beam width in the antenna beams which are obtained.

Such a solution is offered by the present invention in that it discloses an antenna arrangement which comprises a plurality of antenna units, with each antenna unit comprising:

An input port,

A power divider for dividing an input signal from the input port into a major and a minor part, with a certain ratio between the parts, A network with a sum input port, a difference input port, and a first and a second output port. The network is such that signals which are connected to the sum input port of the network are output at both output ports of the network with a first phase relation between the signals at the two output ports, and signals connected to the difference input port of the network are output at both output ports of the network with a second phase relation between them, A first and a second antenna element of respective first and second polarizations.

According to the invention, the antenna units in the antenna arrangement are arranged to cooperate in that their networks and power dividers are arranged so that:

The major part of an input signal to an antenna unit is connected to either the sum or the difference port of a first network and the minor part of an input signal to an antenna unit is connected to the other port of a second network, so that, for example, if the major part is connected to the sum port of a first network, the minor part will be connected to the difference port of a second network, and vice versa.

The first and second output ports of a network are connected to first and second adjacent antenna elements of the same polarization.

As will be shown in the detailed description in this text, such an antenna arrangement offers antenna beams with a lower half power beam width than previous antenna arrangements.

Suitably, the first phase relation is zero degrees and the second phase relation is 180 degrees.

In one embodiment of the invention, the ratio between the major and the minor part is the same in at least two power dividers.

In one embodiment of the invention, the ratio in a power divider is larger than 1:1 or smaller than 1:1.

In one embodiment of the invention, the antenna arrangement comprises a plurality of more than two antenna units.

In one embodiment of the invention, first and second adjacent antenna units cooperate in pairs, so that each of the two output ports of the network in one of the antenna units in a pair are connected to one antenna element of the first polarization in both antenna units, and each of the two output ports of the other network in said pair are connected to one antenna element of the other polarization in both antenna units.

In one embodiment of the invention, the antenna units cooperate in pairs, so that the major part from the splitters in cooperating antenna units are connected to either the sum or difference port of adjacent antenna networks, and the minor part is connected to the other of the sum or difference port of adjacent antenna networks.

In one embodiment of the invention, the ratio in the power divider is complex, i.e. it involves both amplitude and phase, in order to, for example, affect the polarization of the signals, and also to simplify the design demands on the power dividers.

In one embodiment of the invention, the antenna arrangement is reciprocal, i.e. the antenna units are arranged to be used both for transmission and for reception, so that the divider functions as a divider upon transmission and as a combiner upon reception.

These and other embodiments of the invention, as well as advantages gained by means of the invention, will be described in more detail in the description given below.

BRIEF DESCRIPTION OF THE DRAWINGS

The invention will be described in more detail in the following, with reference to the appended drawings, in which.

DETAILED DESCRIPTION

Figure 1:
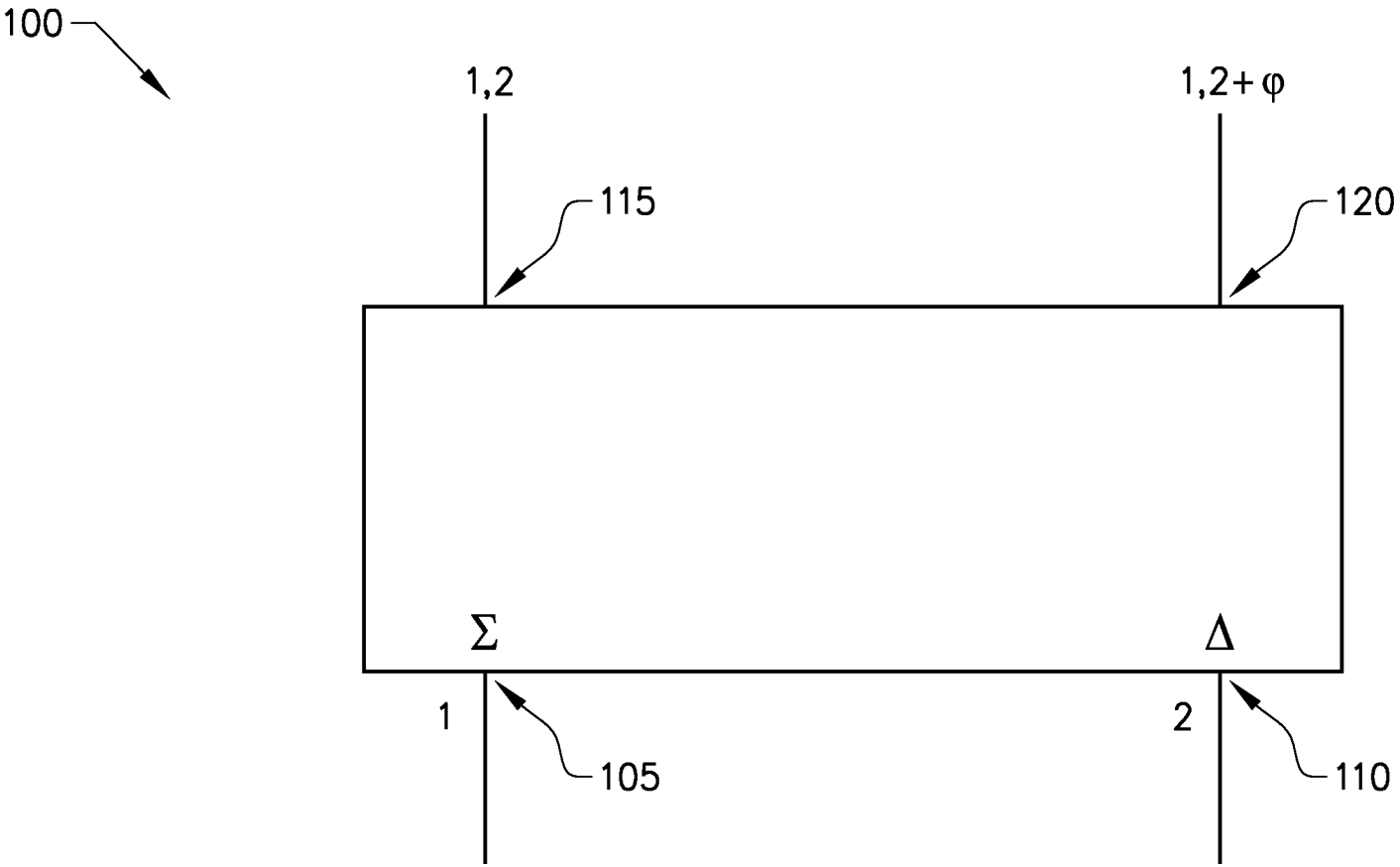
FIG. 1 shows a component used in the invention.

FIG. 1 shows a component which is used in the invention, a network 100, which suitably is a so called hybrid network such as, for example, a phase-shifted Butler matrix. Such networks are well known as such to those skilled in the field, and will therefore only be described briefly here.

As shown in FIG. 1, the network 100 has two input ports, a sum input port 105, and a difference input port 110, and the network 100 also has a first 115 and a second 120 output port. The network is such that a signal which is input at the sum input port 105 is output at both output ports with a first phase relation between the signals at the two output ports, and a signal which is input at the difference port 110 is output at both output ports with a second phase relation $\phi$ between the signals at the two output ports. Suitably, the first phase relation is zero degrees, and the second phase relation is 180 degrees, which are values which will be used in the description below, although, as will also be shown, other values are perfectly possible.

The function of the network is illustrated in FIG. 1 by means of two input signals "1" and "2", one of which is input at each input port of the network 100. As shown, the signal "1" which is input at the sum port 105 is output at both output ports 115, 120, with the same phase, i.e. with a phase relation of zero, while the input signal "2" which is input at the difference port 110 is output at both output ports 115, 120, with the phase relation $\phi$ between the signals at the two output ports. The phase relation $\phi$ can be varied depending on the effect which it is desired to obtain, but in the examples shown here, the effects of a phase relation of a difference of 180 degrees will be illustrated.

A first example of an embodiment 200 of the invention will now be described with reference to FIG. 2. The embodiment 200 comprises two antenna units 220, 230, although the number of antenna units can be varied within the scope of the invention.

Each antenna unit 220, 230, comprises an input port 201, 203, which is connected to a power divider or splitter 202, 204. The dividers divide an input signal into a major and a minor output signal, with a ratio 1:X, where the ratio is defined as the power ratio between the output signals Suitably but not necessarily, the ratio factor X is the same for all of the dividers in the antenna arrangement, and also suitably, the factor "X" is larger than or smaller than 1, so that the divider does not divide into equal parts. The ratio can also, in one embodiment, be varied, for example during operation of the antenna arrangement, in order to vary the beam width.

Each antenna unit also comprises a network 211, 216, with the function described in connection to FIG. 1, and each antenna unit also comprises an antenna element 215, 217 of a first polarization, and an antenna element 214, 218 of a second polarization.

Figure 2:
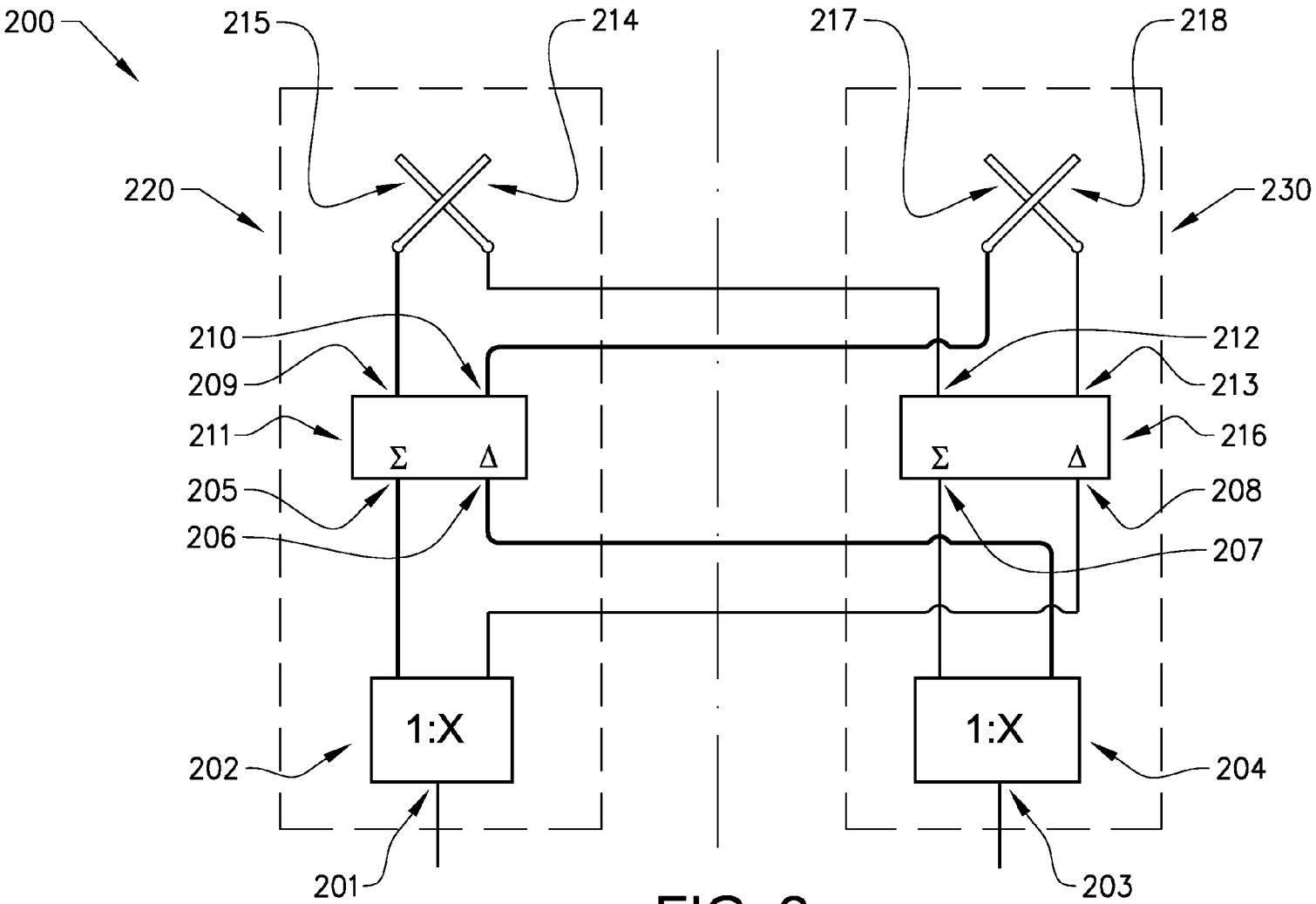
FIGS. 2-4 show examples of embodiments of the invention.

In the example 200 of FIG. 2, adjacent antenna units 220, 230 cooperate so that the major output signal from each divider 202, 204, is connected to the sum input port 205, 207, of the network 211, 216 of the divider's "own" antenna unit 220, 230, while the minor output signal from each divider 202, 204, is connected to the difference input port 208, 206, of the network 216, 211, of the adjacent antenna unit.

Furthermore, as shown in FIG. 2, according to the invention, the first and second output ports of a network are connected to first and second adjacent antenna elements of the same polarization. Thus, the first output port 209 of the network 211 is connected to the antenna element 214 of the second polarization, which is the antenna element of the second polarization of the antenna unit 220, and the second output port 210 of the network 211 is connected to the antenna element 218 of the second polarization, which is the antenna element of the second polarization of the adjacent antenna unit 230.

Similarly, the first output port 212 of the network 216 is connected to the antenna element 215 of the first polarization, which is the antenna element of the first polarization of the adjacent antenna unit 220, and the second output port 213 of the network 216 is connected to the antenna element 217 of the first polarization, which is the antenna element of the first polarization of the antenna unit 230.

By means of the embodiment 200 of FIG. 2, the signal applied to the input port 201 will be transmitted via the antenna elements 215, 217, of the first polarization via a "sum-pattern" with the beam peak in a direction which is perpendicular to the antenna elements, since the signals applied to the two elements have the same phase, and via the antenna elements 214, 218 of the second polarization via a "difference-pattern", with the null in a direction perpendicular to the antenna elements, since the signals applied to the two elements have the a phase difference of 180 degrees.

It should be mentioned here that although the antenna arrangement of the invention has been described by means of examples which are used for transmission, the inventive arrangement is suitably reciprocal, so that it can be used both for transmission and/or for reception. Thus, if the arrangement is used for reception, the networks (with reference to FIG. 1) will combine input signals from the ports 115, 120 and will output signals at the ports 105, 110, in a fashion which is inverse to that described above. Likewise, upon reception, the dividers will act as combiners in a manner which is inverse to that described above.

Thus, as shown in FIG. 2, one principle of the invention is that first and second adjacent antenna units cooperate in pairs, so that the two output ports of the network in one of the antenna units in a pair are connected to the antenna elements of the first polarization in both antenna units, and the two output ports of the other network in said pair are connected to the antenna elements of the other polarization in both antenna units.

An embodiment of the invention will now be shown and described in order to illustrate that according to the invention, it is also possible to let antenna units cooperate in pairs, so that the major part from the dividers in both antenna units of a pair are connected to either the sum or difference port of an adjacent antenna network, and the minor part is connected to the other of the sum or difference port of adjacent antenna networks. In such an embodiment, the outputs from the antenna networks can however be connected to antenna elements of antenna units "outside" the cooperating pair, as will be shown by means of the embodiment 300 of FIG. 3.

Figure 3:
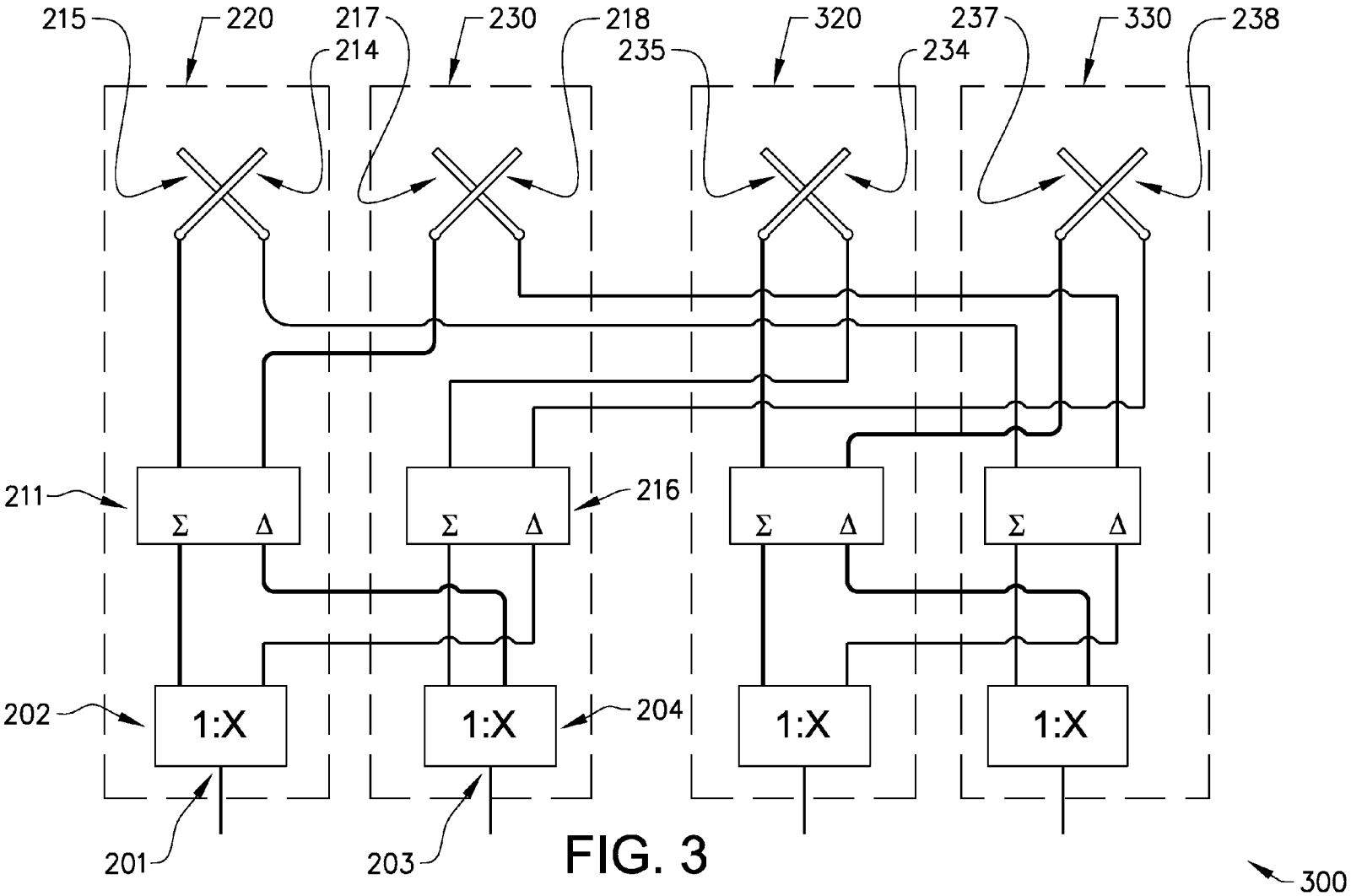

FIG. 3 shows the antenna units 220, 230 of FIG. 2, and third and fourth antenna units 320, 330. As can be seen, the connection from the input ports 201, 203 to the dividers 202, 204 and the connections from the dividers 202, 204 to the networks 211, 216 are the same as those shown in FIG. 2, for which reason they will not be described again here.

However, the outputs from the networks 211, 216 are, as opposed to the embodiment of FIG. 2, connected to antenna elements of non-adjacent antenna units. As can be seen, the first output of the network 211 is connected to the antenna element 214 of the second polarization of the network's "own" antenna unit, and the second output of the network 211 is connected to the antenna element 218 of the second polarization of the adjacent antenna unit, which is the same as in the embodiment 200 of FIG. 2.

As can also be seen in FIG. 3, the first output of the network 216 is connected to an antenna element 234 of the second polarization of the third antenna unit 320, which does not need to be an adjacent antenna unit, although this is what is shown in FIG. 3. The second output of the network 216 is connected to an antenna element 237 of the second polarization of the fourth antenna unit 330. As is also shown in FIG. 3, each of the outputs from the networks of the third 320 and fourth antenna units 330 is connected to one each of adjacent antenna elements of one and the same polarization.

A principle which has been used in the embodiment 300 of FIG. 3 is that first and second adjacent antenna units, i.e. the antenna units 220 and 320 and the antenna units 230 and 330, cooperate in pairs, so that the two output ports of the network in one of the antenna units in a pair are connected to the antenna elements of the first polarization in both antenna units, and the two output ports of the other network in a pair are connected to the antenna elements of the other polarization in both antenna units.

Thus, the principle of using two adjacent antenna elements of the same polarization for the outputs of a network is adhered to in this embodiment as well.

Figure 4:
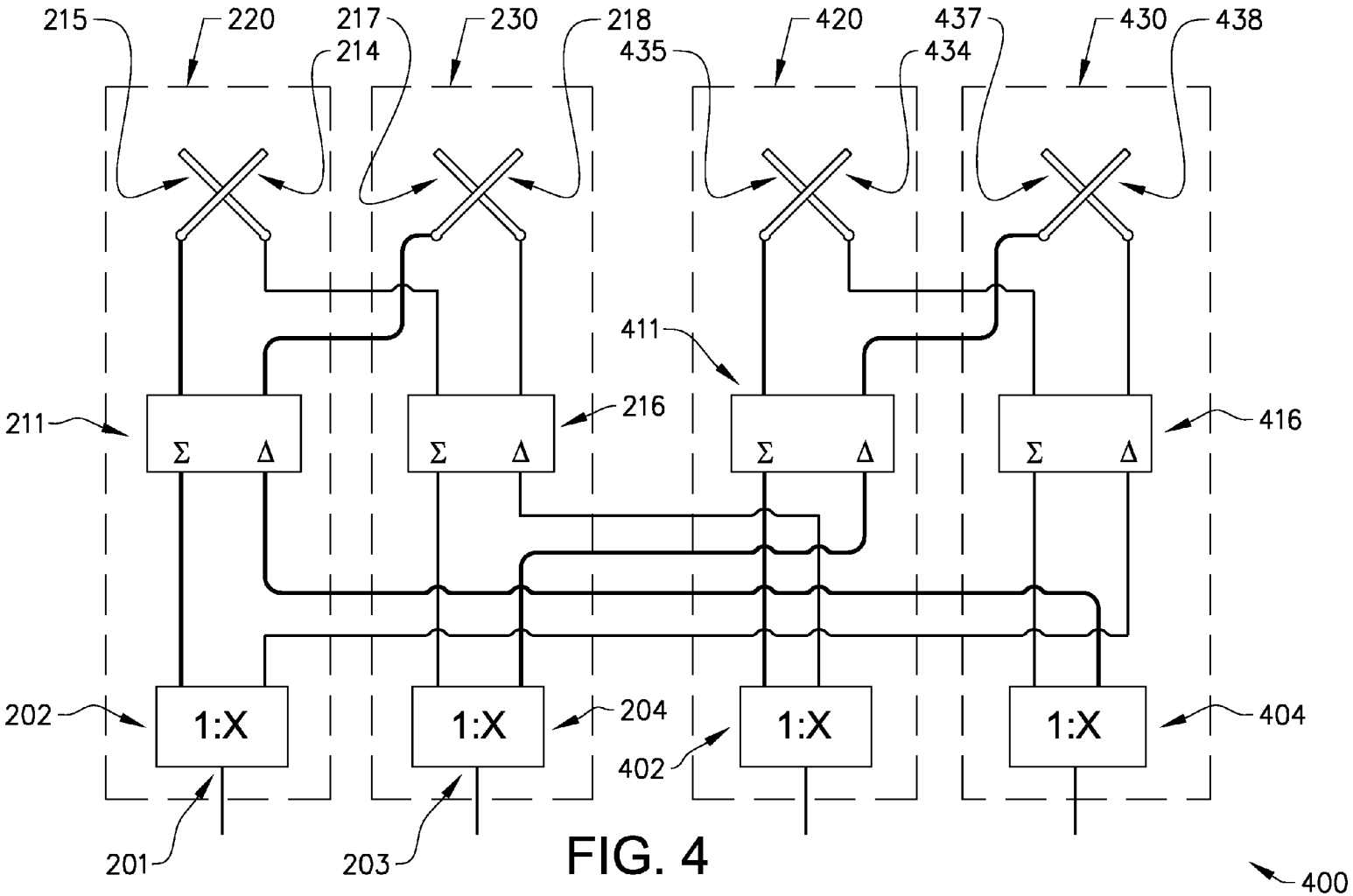

FIG. 4 shows another example of an embodiment 400 which utilizes the principle of letting the first and second output ports of a network be connected to first and second adjacent antenna elements of the same polarization: the embodiment shows the antenna units 220, 230 of FIG. 2, and third and fourth antenna units 420, 430 with respective networks 411 and 416.

As shown, the first output port of the network 211 of the first antenna unit 220 is connected to the antenna element 214 of the second polarization of the first antenna unit, and the second output port of the network 211 is thus connected to the adjacent antenna element 218 of the same polarization, i.e. the second polarization.

A table is given below which shows the antenna elements, AE, to which the first and second output ports ("output port 1, 2") of each network are connected.

| Network | AE, output port 1 | AE, output port 2 |
|---|---|---|
| 216 | 215 | 217 |
| 411 | 435 | 437 |
| 416 | 434 | 438 |

A principle which has been used in the embodiment 400 of FIG. 4 is that antenna units, in this case the antenna units 220-230 and 420-430, cooperate in pairs, so that the major part from the splitters in both antenna units of a pair are connected to either the sum or difference port of adjacent antenna networks, and the minor part is connected to the other of the sum or difference port of adjacent antenna networks As can be seen, the principle of letting the first and second output ports of a network be connected to first and second adjacent antenna elements of the same polarization is adhered to in the embodiment 400 as well. The man skilled in the field will realize that this principle can be used in a large number of variations, all of which fall within the scope of the present invention.

Figure 5:
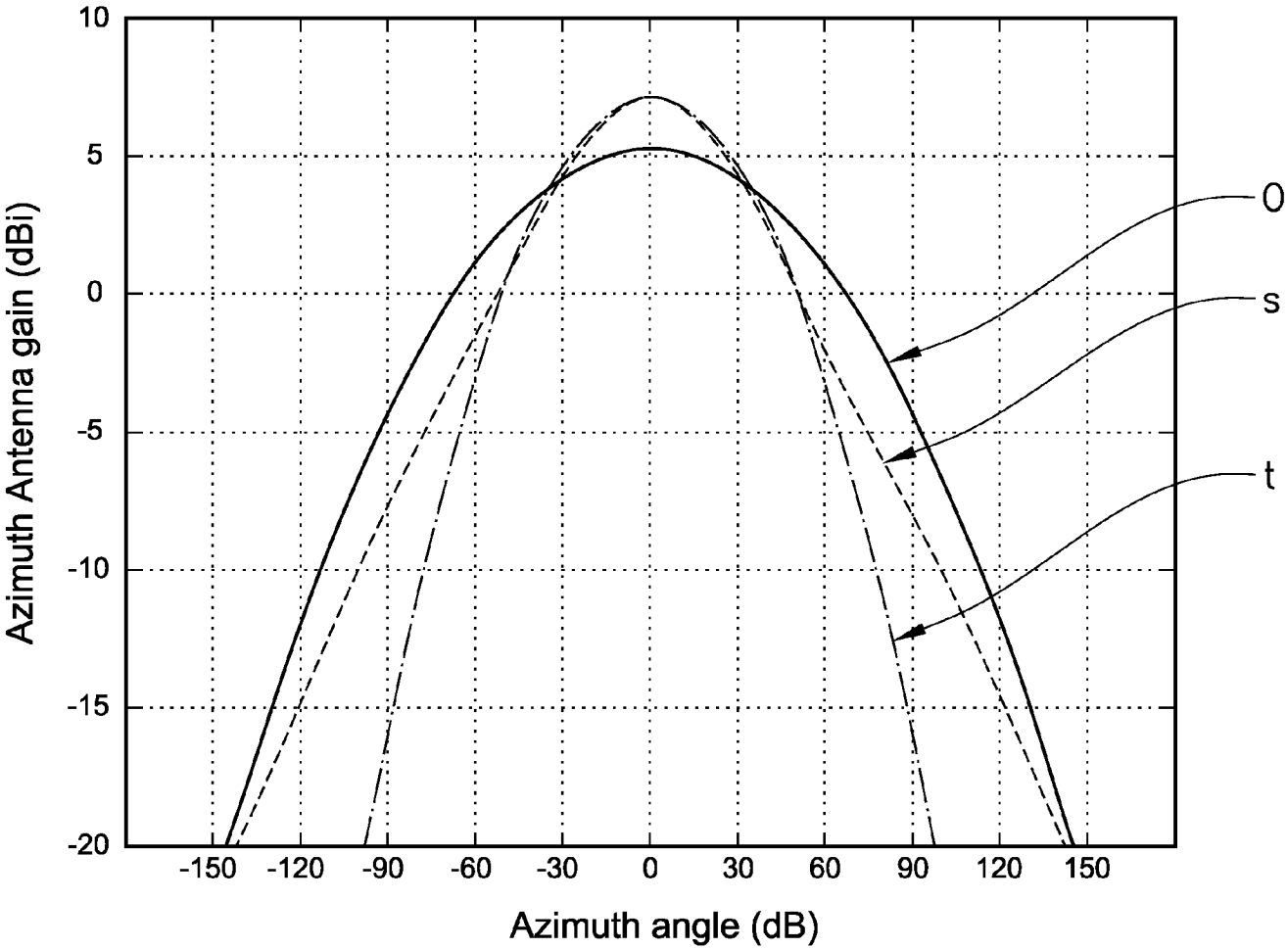
FIG. 5 shows a result obtained by means of the invention.

FIG. 5 shows an example of a reconfigured antenna pattern which has been obtained by means of the invention. The "original" pattern is shown, indicated as "○", as well as a "target pattern" indicated as "t", with a HPBW of 65 deg, and an "synthesized" obtained pattern for a ratio 1:X in the dividers with X=0.3 is indicated as "s". As seen, the obtained pattern offers higher gain than the original pattern as well as reduced interference spread, due to the improved shape of the beam.

A few observations can be given regarding the nature of the networks and dividers which are used in the present invention: As explained in connection to FIG. 1, in a basic embodiment the networks are such that a signal which is connected to the sum input port is output with the same amplitude and phase at both output ports, while a signal which is connected to the difference input port is output at both output ports with the same amplitude but with a phase difference $\phi$, usually 180 degrees, between the output ports, which results in an antenna beam which points in a direction which is perpendicular to the antenna elements, and thus usually also to the antenna units and the total antenna arrangement.

However, an antenna beam can be obtained which points in a different direction relative to the antenna elements, if the networks instead are designed so that a signal which is input at the sum input port of a network is output at both output ports with a phase relation of "A" between the signals at the two output ports and a signal which is input at the difference port of the network is output at both output ports with a phase relation of A+$\phi$ between the signals at the two output ports. Thus, in FIG. 1, the output signals at port 115 would in such an embodiment remain unchanged, while the output signals at port 120 would be 1+A and 2+A+. The value of "A" is decided by the desired direction of the resulting antenna beam.

Regarding the dividers, there are no demands for a certain phase relationship between the signals at the output ports in order to obtain the desired effect.

Finally, it should be pointed out that although the invention has been described with the aid of embodiments in which each antenna unit comprises a first and a second antenna element, the invention is not restricted to antenna units with only one pair of antenna elements each. Thus, in many embodiments of the invention, each antenna unit will comprise a multitude of paired antenna elements, with one antenna element of each polarization.

The invention is not limited to the examples of embodiments described above and shown in the drawings, but may be freely varied within the scope of the appended claims.

The invention claimed is:

1. An antenna arrangement comprising a plurality of antenna units, each antenna unit comprising:

an input port;

a power divider for dividing an input signal from the input port into a major and a minor part, with a certain ratio (1:X) between said parts;

a network with a sum input port, a difference input port, and a first and a second output port, in which signals connected to the sum input port are output at both output ports with a first phase relation between the signals at the two output ports, and signals connected to the difference input port are output at both output ports with a second phase relation between them;

a first and a second antenna element of respective first and second polarizations, wherein antenna units in said plurality are arranged to cooperate in that their networks and power dividers are arranged so that:

said major part of an input signal to an antenna unit is connected to either the sum or the difference port of a first network and said minor part of an input signal to an antenna unit is connected to the other port of a second network, the first and second output ports of a network are connected to first and second adjacent antenna elements of the same polarization.

2. The antenna arrangement of claim 1, wherein the ratio is the same in at least two power dividers.

3. The antenna arrangement of claim 1, wherein the ratio in a power divider is larger or smaller than 1:1.

4. The antenna arrangement of claim 1, comprising more than two antenna units.

5. The antenna arrangement of claim 1, wherein first and second adjacent antenna units cooperate in pairs, so that the two output ports of the network in one of the antenna units in a pair are connected to the antenna elements of the first polarization in both antenna units, and the two output ports of the other network in said pair are connected to the antenna elements of the other polarization in both antenna units.

6. The antenna arrangement of claim 1, wherein the antenna units cooperate in pairs, so that the major part from the splitters in both antenna units of said pair are connected to either the sum or difference port of adjacent antenna networks, and the minor part is connected to the other of the sum or difference port of adjacent antenna networks.

7. The antenna arrangement of claim 1, wherein the ratio in at least one power divider involves both amplitude and phase, in order to affect the polarization of the signals.

8. The antenna arrangement of claim 1, wherein the antenna units are arranged to be used both for transmission and for reception, so that the dividers function as a divider upon transmission and as a combiner upon reception.

9. The antenna arrangement of claim 1, wherein the first phase relation is zero degrees.

10. The antenna arrangement of claim 1, wherein the second phase relation is 180 degrees.

* * * * *